United States Patent [19]

Moore, Jr.

[11] 4,268,551

[45] May 19, 1981

[54] ARTIFICIAL GRASS SURFACE AND METHOD OF INSTALLATION

[75] Inventor: Mack W. Moore, Jr., Dalton, Ga.

[73] Assignee: Cavalier Carpets, Dalton, Ga.

[21] Appl. No.: 87,671

[22] Filed: Oct. 24, 1979

[51] Int. Cl.[3] ..... E01C 7/00

[52] U.S. Cl. ..... 428/17; 156/72; 156/276; 156/330; 428/95

[58] Field of Search ..... 428/17, 95; 156/72, 156/330, 276

[56] References Cited

U.S. PATENT DOCUMENTS

| | | | |
|---|---|---|---|
| 2,515,847 | 7/1950 | Winkler | 428/17 |
| 3,332,828 | 7/1967 | Faria | 428/17 |
| 3,573,142 | 3/1971 | Chidgey | 428/17 |
| 3,596,576 | 8/1971 | Cicero | 428/17 |
| 3,597,297 | 8/1971 | Buchholtz | 428/17 |
| 3,661,687 | 5/1972 | Spinney | 428/17 |
| 3,673,056 | 6/1972 | Nadler | 428/17 |
| 3,740,303 | 6/1973 | Alderson | 428/17 |
| 3,974,312 | 8/1976 | Stevens | 428/17 |

*Primary Examiner*—Marion McCamish

*Attorney, Agent, or Firm*—Kerkam, Stowell, Kondracki & Clarke

[57] ABSTRACT

An artificial grass carpet is adhered to the ground by multiple layers of a polyester resin. The first layer coats the ground and acts as a stabilizer. The second layer is reinforced with chopped fiberglass roving or a fiberglas or scrim mat. The grass carpet is bonded to the second layer.

16 Claims, 1 Drawing Figure

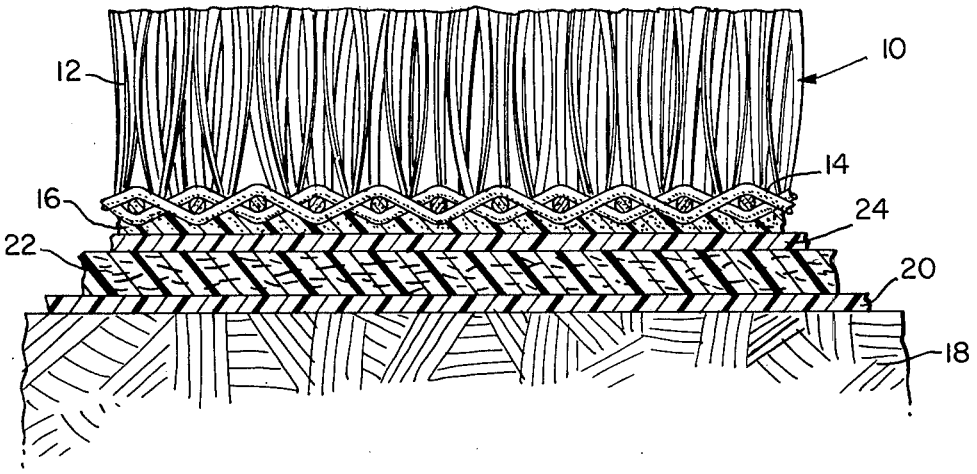
10
12
14
16
24
22
20
18

ARTIFICIAL GRASS SURFACE AND METHOD OF INSTALLATION

BACKGROUND OF THE INVENTION

1. Field of the Invention

The invention relates to artificial grass surfaces.

2. Description of the Prior Art

A natural grass surface, be it a lawn or a recreational playing surface, such as a football field surface, a tennis court surface, a golf green surface, or the like, requires an extensive amount of cultivation and maintenance to preserve uniformity of appearance. The high cost of such maintenance and cultivation of natural grass surfaces has led to recent development of artificial grass-like products. The use of such artificial grass products has achieved a large measure of popularity in surfacing recreational and playing field areas which receive hard wear. Typical examples of artificial grass surfaces and their application in the prior art are illustrated and described in U.S. Pat. Nos. 2,515,847; 3,332,828; 3,597,297; 3,661,687; 3,673,056; 3,740,303; and 3,974,312.

Artificial grass products are generally designed for application to commercial recreational areas such as golf greens, tennis courts, baseball fields and football fields. These products are primarily adhered to hard surfaces such as asphalt or cement or special underlying basis. In any case, there is required costly subsurface preparation. While such costs may be justified for commercial enterprises, there is particular need for providing low cost landscaping for homeowners, small commercial property owners, governmental agencies, and the like entrusted with landscaping of small areas such as lawns, highway media strips, sidewall media strips, which need has not been met by known artificial surfaces methods of installation.

SUMMARY OF THE INVENTION

A method of adhering artificial grass surface is provided which eliminates costly subsurfaces. The artificial grass is adhered directly to the soil at hand which need only be compacted and stabilized and reinforced by an intermediate fiberglas reinforced plastic composite (FRP). The artificial grass surface is adhered to the reinforced resin layer by a urethane adhesive and there is thus provided a comparatively low-cost low-maintenance installation which can readily be used for landscaping small areas. An intermediate shock absorbing pad may be provided if the product is to be used for recreational purposes such as for athletic fields.

BRIEF DESCRIPTION OF THE DRAWING

The FIGURE is a fragmentary, enlarged, cross-sectional view of an artificial grass surface installation in accordance with the present invention.

DESCRIPTION OF THE PREFERRED EMBODIMENTS

Referring now to the drawing, there is illustrated a portion of an artificial surface installed in accordance with the present invention. Reference character 10 identifies a first or top layer of artificial grass material comprising a layer of carpet-like material having upstanded grass-like filaments 12 and a primary backing 14. The filaments may be locked into the primary backing by a suitable secondary backing formed by latex adhesive 16.

Artificial grass carpets, as such, are well known and reference may be made to the aforementioned U.S. Pat. Nos. 3,332,828; 3,573,147; 3,661,687; and 3,673,056 for examples of artificial grass carpets suitable for use in the present invention and methods of making such carpets. It should be appreciated that artificial grass carpets are nothing more than an all-synthetic tufted, woven or molded carpet having a pile face of fibers of a denier that gives the appearance of natural grass blades. The fibers may be extruded from polyamides, polyesters, or polypropylene and may be of round, oval, flat or other cross-sectional configuration or fibrillated. Preferably, flat ribbon, dyed green, is generally used for the pile face to simulate the appearance of natural grass. The latter description of the artificial grass surface covering is given for general information only since such carpets or surface coverings are well known and are presently commercially available from several companies. The particular construction of the artificial grass carpet is not part of the present invention.

In accordance with the invention, the artificial grass surface is adhered to soil surface 18 which has first been stabilized by a plastic resin layer 20, such as a polyester resin. Any suitable polyester resin may be employed such as, for example, the unsaturated polyester resins sold by Reichold Chemicals, Inc. (RCI) and identified in the RCI Technical Bulletin, Polylite 33-031, Polyester Resin.

After stabilization of the soil surface and curing of the stabilizing layer 20, a fiberglas reinforced plastic layer 22 is applied. Reinforcing layer 22 may take the form of a plastic resin reinforced with chopped fiberglas roving spray coated over the stabilizing layer with an airless Binks spray applicator to form a seamless matrix wherein the chopped fiberglas is randomly dispersed. Alternatively, layer 22 may be formed by a non-woven fiberglas or scrim reinforcing mat which is saturated with and penetrated by the plastic resin spray to insure that the second layer 22 bonds to the first layer 20. The plastic resin used to form such a reinforcing layer 22 may be the same as that of the stabilizing layer. Such polyesters offer the advantage of ease of handling and good temperature stability. Additives or fillers such as carbonates, clays, talcs, sulfates which give opacity to the coatings, reduce shrinkage, provide weather resistance and other desirable properties are easily incorporated into the resin.

The next layer 24 of the invention is an adhesive which is applied over the cured fiberglas reinforcing layer 22. Preferably, an outdoor urethane adhesive is used such as that commercially available from Synthetic Surfaces, Inc. and sold under the name of VORITE 677 M-3. This adhesive has found wide application in outdoor installations for bonding of artificial turf to asphalt and cement undersurfaces. However, any suitable multi-purpose adhesive may be used which bonds the backing 16 of the artificial grass material to the reinforced resin layer 22.

EXAMPLE

An artificial grass surface according to the invention was formed on a ground area of approximately 161 square feet, generally flat and rectangular in shape.

In preparing for the installation of the artificial grass surface in accordance with the invention, the soil was first contoured to the desired shape. The perimeter was defined and the soil made smooth and cleared of obvious unwanted objects and debris such as twigs, sticks, rocks and so forth. To this end, the soil was loosened and thereafter watered to settle the loose soil. The watering should not be so great as to cause erosion or change the contour of the soil and a light sprinkling was found sufficient. The soil was allowed to dry to a workable degree, and then the soil was compacted by tamping and rolling. Any further loose stones or debris visible to the naked eye were removed and further tamping and rolling was performed to provide a smooth soil surface area.

The smooth surface area was then stabilized by the application of a plastic resin. In the particular example, a one-quarter inch resin layer was formed from eleven gallons of Polylite 33-031 polyester resin to which was added seven and three quarter pounds per gallon of calcium carbonate filler and two ounces of MEKP Super 60 resin catalyst. The catalyst percentage may be varied to adjust cure time. MEKP Super 60 is a 60% methyl, ethyl, ketone, peroxide dimethyl phthalate solution and is commercially available from the aforenoted RCI company. The amount of catalyst used depends to some extent on desired curing time which in turn depends on outdoor temperature and humidity conditions. The catalyst should preferably allow curing of the stabilizing layer in about 20 minutes at a temperature of 70° to 80° and a humidity of 20%.

The resin stabilizing layer 20 was applied by spraying directly onto the soil surface 18. All mixing was external. A resin layer approximately one-quarter inch thick was formed over the soil which was found sufficient to cover and seal the surface area.

It has been found that under excessively moist conditions or with sandy or soft ground conditions, a single resin stabilizing layer has a tendency to break down. Thus a second application of a stabilizing layer may be applied in such situations. In addition, in sandy conditions, a water-soluble AMES adhesive may be applied by spraying directly on the soil prior to application of the stabilizing resin layer. The adhesive should be applied in sufficient quantity to work itself between the sand granules and below the soil surface.

After the resin layer was cured, a fiberglas reinforced resin layer was applied mixing 30% chopped fiberglas roving and 70% resin, including additives. The fiberglas and catalyzed resin were applied simultaneously by a Binks sprayer. Roving was fed through a chopper and into the resin-catalyst stream. The materials were sprayed directly on the cured stabilizing layer using a Binks airless external mix spray gun. Chopped glass roving was delivered in the gun at a rate of approximately 11 pounds per minute. The resin included additives in the proportions noted above. The fiberglas-reinforced plastic resin cured in approximately 20 minutes to form a firm base layer approximately one-quarter inch thick. Preferably, layer 22 may be somewhat thicker than layer 20 to provide additional reinforcement and increased toughness.

The final step of the process is to apply the artificial grass layer 10. A urethane adhesive was coated on the cured reinforced layer 22 and the carpeting material 10 rolled out. The adhesive was applied at one end of the predetermined area covering approximately half of the surface area. The carpet was thereafter rolled out up until the point of application of the adhesive. Further adhesive was applied and the carpet fully rolled out. After bonding, the carpet was edge cut. If desired, the perimeter may be defined by using wood 2 by 4 borders in which case the carpet is overlapped on the 2 by 4's and either bonded thereto with the adhesive or affixed by other suitable means.

As hereinbefore noted, the fiber reinforcing layer 22 may be formed by using a scrim or non-woven fiberglas mat which has applied thereto a resin material that saturates and penetrates the mat and upon curing binds the mat to the stabilizing layer 20. Thereafter, the adhesive 24 is applied to the mat layer.

In the case of a recreational surface, a shock absorbing pad (not shown) may be adhered to the reinforced plastic layer 22 using a urethane adhesive. The artificial grass carpet 10 is then adhered to the shock absorbing pad.

While a specific embodiment of the invention has been described, it should be apparent to those skilled in the art that various modifications thereof may be made without departing from the true spirit and scope of the invention. Accordingly, it is intended by the appended claims to cover all such modifications which fall within the full inventive concept.

I claim:

1. A method for adhering an artificial grass carpet product to a soil surface comprises preping a predetermined area of the soil surface to remove all debris and provide a defined compact surface within said predetermined area, coating said compact surface with a first stabilizing layer of plastic resin, allowing said first layer to cure and thereafter applying to said first cured stabilizing layer a second layer of resin reinforced with a fiberglas component, allowing said second layer to cure and thereafter applying a third adhesive layer to said cured reinforced layer of resin and applying to said adhesive layer the artificial grass carpet product so as to cause said carpet product to be bonded to said cured reinforced layer of resin.

2. A method as set forth in claim 1 wherein said first and said second layers are applied by spraying.

3. A method as set forth in claim 1 or 2 wherein the resin forming said first and second layers is a polyester resin.

4. A method as set forth in claim 1 or 2 wherein said second layer is reinforced with chopped fiberglas roving, said fiberglas roving and resin being intermixed during the spraying application and the resin forming said first and second layers is a polyester resin.

5. A method as set forth in claim 4 wherein said reinforced layer is applied by mixing 30% chopped roving and 70% resin, including filler.

6. A method as set forth in claim 5 wherein said roving is fed through a chopper into a resin-catalyst stream.

7. A method as set forth in claim 1 wherein said second layer comprises a mat saturated with said second applied resin, said resin being applied in sufficient quantity so as to saturate and penetrate said mat and cause said second applied resin upon curing to bond said reinforced layer to said stabilizing layer.

8. A method as set forth in claim 7 wherein said mat is non-woven fiberglas.

9. A method as set forth in claim 7 wherein said mat is a scrim.

10. An artificial grass surface comprising a first soil stabilizing layer of plastic resin covering a predetermined ground surface area, a second plastic resin layer bonded to said first layer, said second layer including a reinforcing component of fiberglas, an artificial grass carpet covering said second layer and an adhesive layer bonding said carpet to said second layer.

11. An artificial grass surface as set forth in claim 10 wherein said reinforcing component is fiberglas cuttings randomly distributed in said second layer.

12. An artificial grass surface as set forth in claim 11 wherein said second layer comprises 30% chopped fiberglas roving and 70% resin, including filler.

13. An artificial grass surface as set forth in claim 10 wherein said reinforcing component is a mat saturated with said second plastic resin which upon curing bonds said second layer to said first layer.

14. An artificial grass surface as set forth in claim 11 or 13 wherein said first and said second resin is a polyester resin.

15. An artificial grass surface as set forth in claim 14 wherein the thickness of said first and said second layers is approximately one-quarter inch each.

16. An artificial grass surface as set forth in claim 13 wherein said first layer is approximately one-quarter inch thick and said second layer is greater in thickness to provide additional reinforcement and increased toughness.

* * * * *